US006213804B1

(12) United States Patent
Matsumura

(10) Patent No.: US 6,213,804 B1
(45) Date of Patent: Apr. 10, 2001

(54) SOCKET AND CONNECTOR

(75) Inventor: Shigeru Matsumura, Tokyo (JP)

(73) Assignee: Advantest Corporation, Tokyo (JP)

( * ) Notice: Subject to any disclaimer, the term of this patent is extended or adjusted under 35 U.S.C. 154(b) by 0 days.

(21) Appl. No.: 09/457,764

(22) Filed: Dec. 10, 1999

(30) Foreign Application Priority Data

Dec. 10, 1998 (JP) ..... 10-351495
Apr. 19, 1999 (JP) ..... 11-111433

(51) Int. Cl.[7] ..... H01R 11/22
(52) U.S. Cl. ..... 439/267; 439/637
(58) Field of Search ..... 439/260, 261, 439/262, 267, 637, 839

(56) References Cited

U.S. PATENT DOCUMENTS 4,047,782 * 9/1977 Yeager ..... 439/267
4,591,222 * 5/1986 Shaffer ..... 439/267
4,606,594 * 8/1986 Grabbe et al. ..... 439/260
4,739,257 * 4/1988 Jenson et al. ..... 439/260
5,052,936 * 10/1991 Biechler et al. ..... 439/260
5,795,172 * 8/1998 Shahriari et al. ..... 439/260
5,995,378 * 11/1999 Farnworth et al. ..... 439/260
6,004,151 * 12/1999 Hashiguchi ..... 439/260

* cited by examiner

*Primary Examiner*—Brian Sircus
*Assistant Examiner*—Hae Moon Hyeon
(74) *Attorney, Agent, or Firm*—Pillsbury Winthrop LLP Intellectual Property Group

(57) ABSTRACT

A socket for receiving a semiconductor component (10) having an electric terminal (12) comprises a contact (31), to which the electric terminal is connected, and a driving mechanism for moving the contact (31) toward the electric terminal (12) when the semiconductor component is inserted into an insertion position in the socket. The driving mechanism has a movable separation member (40) for keeping the contact (31) away from the insertion position of the semiconductor component (10) when the semiconductor component is not inserted in the socket. The socket also has a spring (50) which is compressed as the semiconductor component (10) is inserted, and pushes back the movable separation member (40) toward the semiconductor component.

15 Claims, 13 Drawing Sheets

SOCKET AND CONNECTOR

This patent application claims priority based on Japanese patent application, H10-351495 filed on Dec. 10, 1998 and H11-111433 filed on Apr. 19, 1999, the contents of which are incorporated herein by reference.

BACKGROUND OF THE INVENTION

1. Field of the Invention

The present invention relates to a socket for receiving an electric component, having an electrical component, a connector that contains the socket, and an inserter which holds the electrical component. In particular, the present invention relates to a socket and a connector thereof which can easily and reliably receive electric components, and at the same time, have a high durability against insertion and removal of the electric components.

2. Description of the Related Art

Conventional sockets for receiving electrical components, such as semiconductor components, generally have a contact for connecting with the electric terminal of a semiconductor component inserted in the socket, and a pressing mechanism for pressing the contact against the electric terminal. The conventional sockets are of two types, a non-zero insertion-force type and a zero insertion-force type. With the non-zero insertion-force type, when the semiconductor component is inserted into the socket, it presses the contact back against the pressing mechanism. With the zero insertion-force type, the semiconductor component does not press the contact back against the pressing mechanism during its insertion.

A semiconductor component can be inserted into the socket of the zero insertion-force type with little insertion force. However, with this of socket type, the contact cannot be maintained with the electric terminal of the semiconductor component if the semiconductor component is simply inserted into the socket. Accordingly, the zero insertion-force type socket generally has mechanical means, such as a lever, for keeping the contact in touch with the electric terminal of the semiconductor component.

In constant, the non-zero insertion-force type socket lacks durability and due to its structure, the insertion and removal of the semiconductor components cause the contact of the socket to be worn out. That is, the contact of the socket rubs against the semiconductor component during insertion and removal. Moreover, the contact tends to damage the electric terminal of the semiconductor component. The lack of durability and the possible damage to the electric terminal are major shortfalls in the semiconductor component test since a number of semiconductor components are repeatedly tested.

The zero insertion-force type socket has a higher durability because the contact of the socket not rubs against the electric terminal of the inserted component. However, because there is no rubbing motion (or wiping motion) between the contact and the electric terminal, connection may not be reliably established with the electric terminal when the surface of the electric terminal is oxidized, or when dust or other undesirable particles adhere on the surface of the electric terminal. In addition, because an extra step is required in moving the lever in order to mount the semiconductor component, the retaining mechanism of the socket becomes complicated, and the total test time increases when a number of semiconductor components are to be repeatedly tested.

SUMMARY OF THE INVENTION

Therefore, it is an object of the present invention to provide a socket and a connector which overcome the above problems in the related art. This object is achieved by combinations described in the independent claims. The dependent claims further define advantageous and exemplary combinations of the present invention.

In order to achieve the object according to a first aspect of the invention, a socket, for receiving an electric component having an electric terminal, comprises a contact, to which the electric terminal of the electric component is to be corrected, and a driving mechanism for moving the contact toward the electric terminal.

The driving mechanism has a movable separation member for keeping the contact away from the insertion position of the electric component when the electric component is not inserted in the socket. Preferably, the socket further comprises a spring which is compressed as the electric component is inserted into the socket, and pushes the movable separation member toward the electric component. The electric component is, for example, a RIMM type semiconductor module having a plurality of electric terminals on both faces of the component. In this case, the socket has a plurality of contacts, each corresponding to one of the electric terminals.

The socket may further comprise a pushing member for pushing the contact toward the electric terminal of the electric component inserted into the socket. In this case, the driving mechanism includes a mechanism for moving the movable separation member in response to the insertion of the electric component into the socket. The motion of the movable separation member causes the pushing member to bring the contact into contact with the electric terminal of the electric component.

During insertion of the electric component into the socket, the contact is wiped against the electric terminal of the electric component. This wiping action reliably brings the contact in electrical connection with the electric terminal of the electric component.

The contact and the pushing member may be integrally formed into a single pin. In this case, the socket further comprises a housing accommodating the movable separation member and the spring, and a pin holder for holding the pin, the pin holder being detachable from the housing so as to allow the pin to be replaced easily. Preferably, the housing has a protector for protecting the contact, the protector being positioned between the home position of the contact, at which the contact stays when the electric component is not inserted in the socket, and the insertion position of the electric component. This arrangement prevents the contact from touching undesirable regions of the electric component when the electric component is inserted into and removed from the socket.

The socket may further comprises a conductive layer formed in a part of the surface area of the pin, and an insulating layer for insulating the conductive layer from the pushing member. This arrangement can reduce the electrical impedance of the pin. The conductive layer and the insulating layer are preferably formed in a part of the surface area of the pin which does not come into contact with either the electric terminal of the electric component or the movable separation member of the socket, o that the conductive layer and the insulating layer will not be worn.

The socket may further comprise a positioning member which positions the electric component in a position in which the electric component is to be inserted into the socket. The positioning member may have a taper part on at least a part of the periphery of the insertion position. This taper part introduces the electric component into the insertion position. The electric component may have a reference member which is a reference for positioning the electric component against the socket, and the positioning member may have a reference corresponding member, which engages with the reference member, at the insertion position.

The positioning member may further have a reference corresponding member holder which holds the reference corresponding member at the insertion position so that the reference corresponding member can be inserted into and removed from the reference corresponding member holder. The reference member maybe located in different positions according to he type of electric component. The reference corresponding member holder can hold the reference corresponding member at a position where the reference corresponding member can engage with the reference members of a plurality of types of electric components.

According to the second aspect of the present invention, a connector comprising: an inserter which holds a semiconductor component having an electric terminal; and a socket to which the inserter is connected can be provided. The connector can be provided such that the inserter has: a position fixing member which fixes the semiconductor component at a predetermined position inside the inserter, and a first structure member which determines the connecting point of the inserter against the socket for inserting the semiconductor component into an insertion position of the socket; and the socket has: a second structure member which engages with the first structure member of the inserter, a contact which contacts with the electric terminal, and a driving mechanism for moving the contact toward the electric terminal when the semiconductor component is moved into the insertion position in the socket.

The position fixing member may have a sandwiching member which sandwiches a predetermined pair of opposite faces of the semiconductor component. The semiconductor component may have a reference member which is a reference for positioning the semiconductor component against the inserter, and the position fixing member may have a reference corresponding member, which engages with the reference member, at the insertion position.

According to the third aspect of the present invention, a connector comprising: an inserter which holds a semiconductor component having an electric terminal; and a socket to which the inserter is connected, can be provided. The connector can be provided such that the inserter has a holding member which movably holds the semiconductor component inside the inserter, and a first structure member which determines the connecting position of the inserter against the socket; and the socket has: a second structure member which engages with the first structure member of the inserter, a positioning member which positions the semiconductor component to an insertion position of the socket, a contact which contacts with the electric terminal, and a riving mechanism for moving the contact toward the electric terminal when the semiconductor component is inserted into the insertion position.

The semiconductor component may have a reference member which is a reference for positioning the semiconductor component against the socket; and the positioning member has a reference corresponding member, which engages with the reference member, at the insertion position. The positioning member may further have a reference corresponding member holder which holds the reference corresponding member at the insertion position so that the reference corresponding member can be inserted into and removed from the reference corresponding member holder. The reference member may be located at different positions according to the type of semiconductor component. The reference corresponding member holder can hold the reference corresponding member at a position where the reference corresponding member can engage with the reference members of a plurality of types of semiconductor components.

This summary of the invention does not necessarily describe all essential features so that the invention may also be a sub-combination of these described features.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1A:
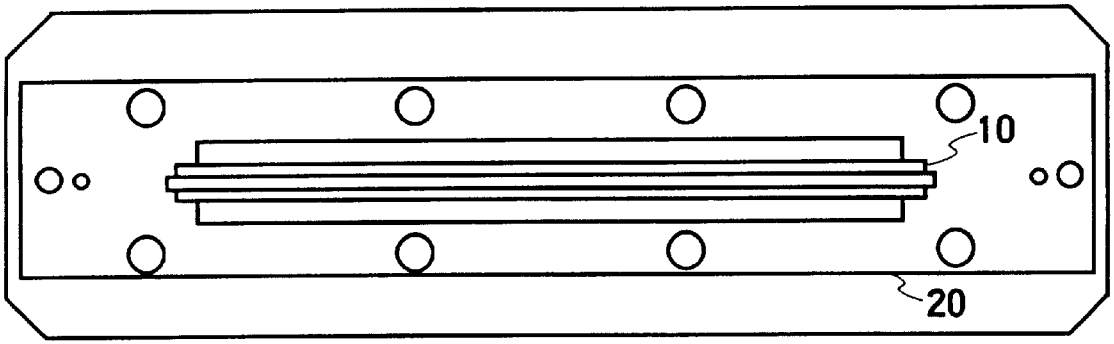
FIGS. 1A to 1C shows plan views of a socket of the present invention.
Figure 1B:
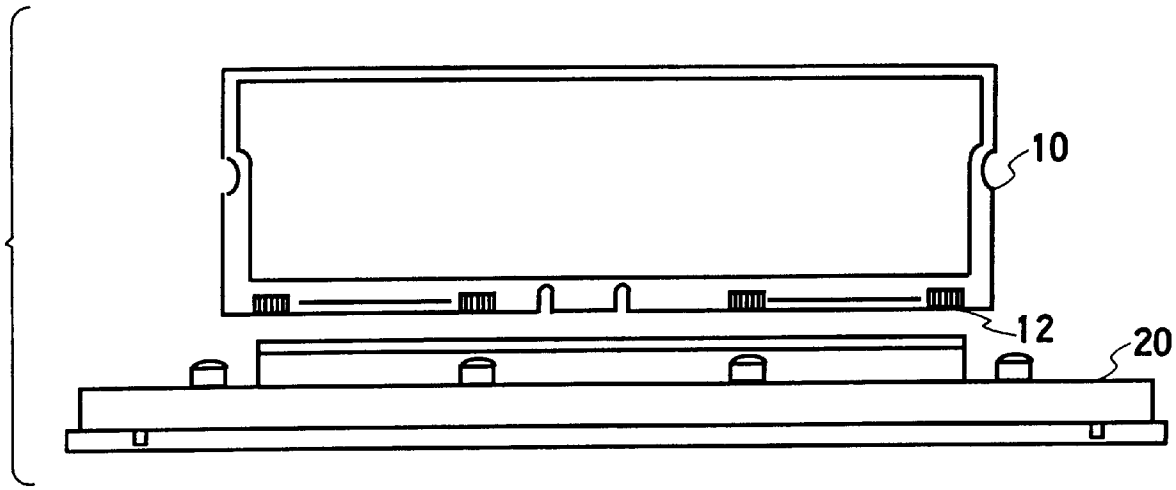
Figure 1C:
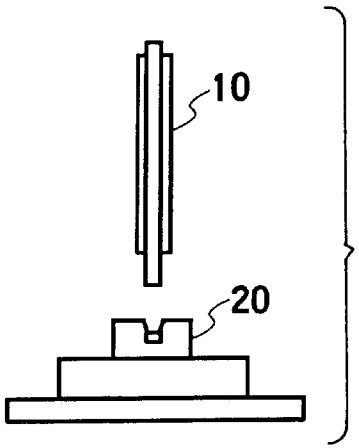

FIGS. 1A to 1C show an example of a socket of an embodiment of the present invention. A semiconductor component 10, which is one example of an electric component that can be used with a socket of the present invention, is inserted into a socket in a vertical manner. The semiconductor component 10 of the present embodiment is a Rambus Inline Memory Module (RIMM) type semiconductor memory module. The semiconductor component 10 has a plurality of electric terminals 12 on both faces. The, electric components for use with this invention are not limited to this type, for example, a semiconductor component such as a memory chip. The electric components may also be a cable connector, modem card, ISDN card, flush memory card, IC card such as smart media, and a power supply plug.

Figure 2A:
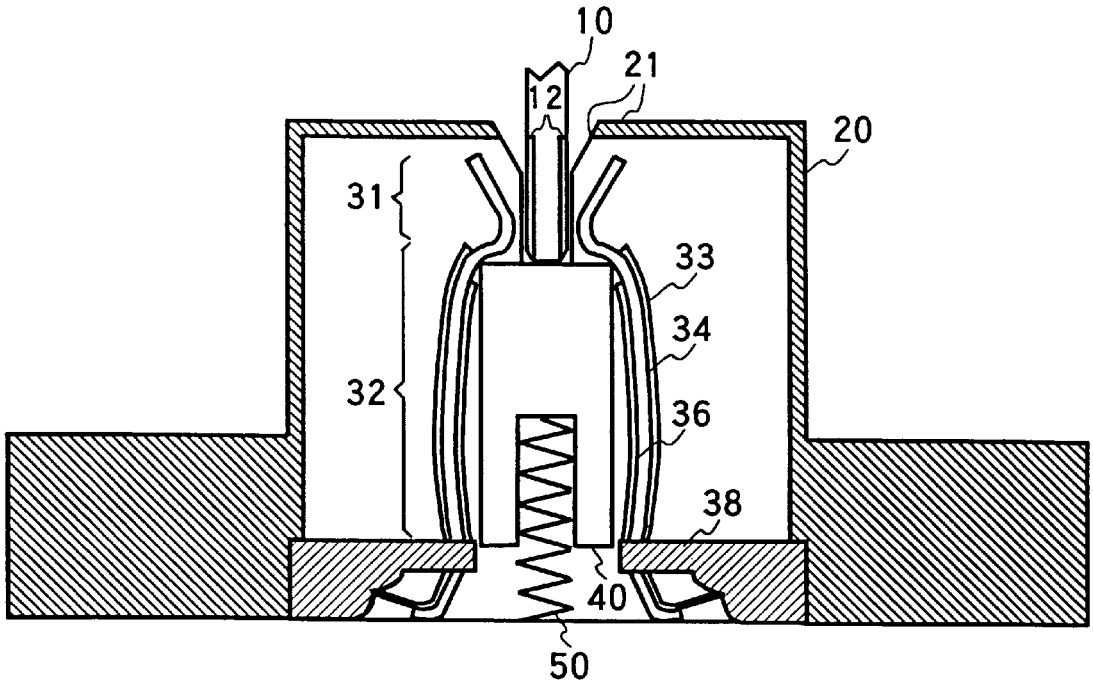
FIG. 2A shows a cross sectional view of the socket with the inserted semiconductor component 10 at an initial position in contact with a the movable separation member 40.
Figure 2B:
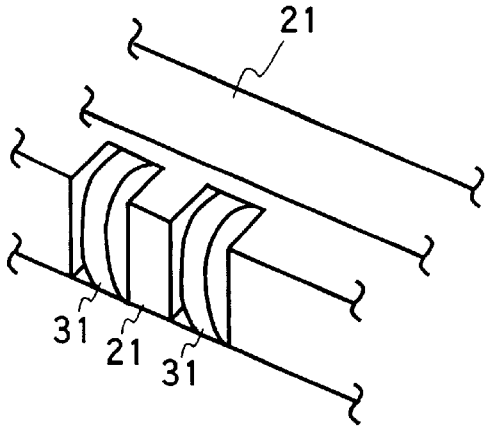
FIG. 2B shows a partial view of the socket along an oblique direction thereof.

FIG. 2A is a cross-sectional view of a socket with a semiconductor component 10 inserted into the socket at an initial position in slight contact. FIG. 2(B) shows an oblique view of a part of the socket. The socket of the present invention has a housing 20, a pin older 38, a plurality of pins 34, conductive layers 33 and 36, and an insulating layer. The housing 20 supports the pin holder 38. The plurality of pins 34 are installed on the pin holder 38. The conductive layer 33 and 36 are provided on the surface of the pins 34.

The insulating layer is made of, for example, epoxy resin and is provided between the conductive layers 33 and 36 and the pins 34. Because the pins 34 and the conductive layers 33 and 36 are capacity coupled to each other, via the insulating layer, the surface area of the high frequency propagation path is increased by the conductive layers 33 and 36. Therefore, electric impedance of the pins 34 against high frequency waves can be set arbitrarily.

Figure 3:
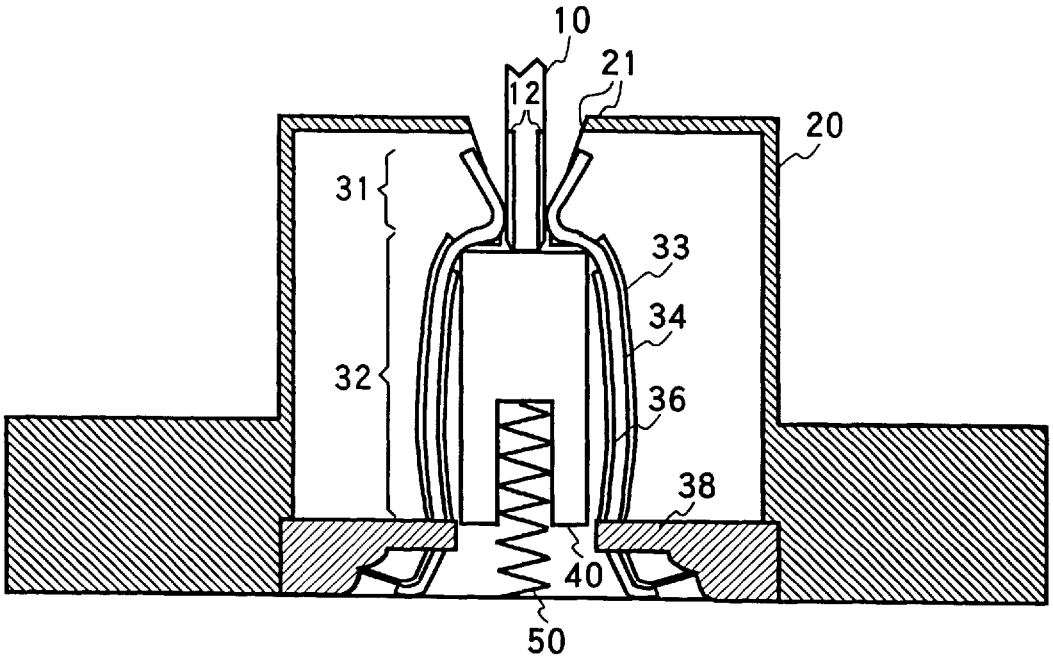
FIG. 3 shows a cross sectional view of the socket with the semiconductor component 10 at an intermediate position at which the contact 31 contacts with the electric terminal 12.
Figure 4:
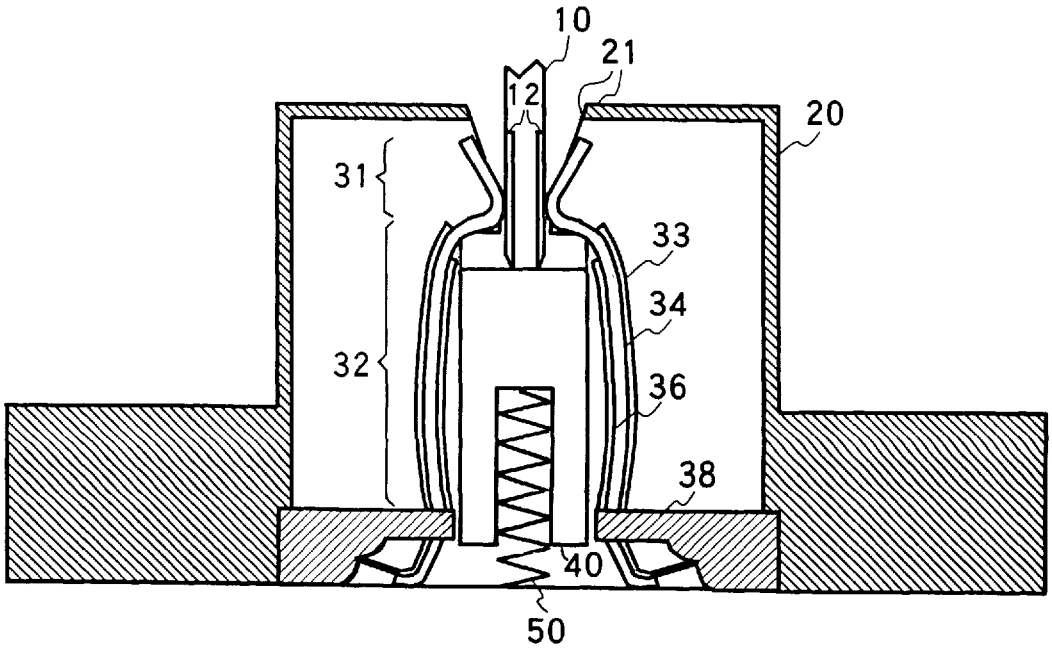
FIG. 4 shows a cross sectional view of the socket with the semiconductor component 10 at a position that is further inserted into the socket and in full engagement with the socket.

Referring also to FIGS. 3 and 4, each of the pins 34 has a contact 31 and a pushing member 32. The contact 31 contacts with the electric terminal 12 of the semiconductor component 10. The pushing member 32 pushes the contact 31 to move toward the electric terminal 12 as described hereafter. The socket has a mechanism for controlling drive of the contact 31 toward the electric terminal 12 known herein as a "driving mechanism". As an example, the driving mechanism has a movable separation member 40 and a spring 50. The operation of this driving mechanism results in movement of the contact 31 toward the electric terminal 12 when the semiconductor component 10 is inserted into the socket (see FIGS. 3 and 4). The movable separation member 40 and the spring 50 are supported by the housing 20. When the semiconductor component 10 is not inserted into the socket, the movable separation member 40 and the spring 50 keep the contact 31 at a position away from the insertion position of the semiconductor component 10. See FIG. 2A with the semiconductor component 10 at an initial position partially inserted into the socket and the contact 31 separated from the electric terminal 12. See also FIGS. 3 and 4 showing subsequent position of the semiconductor component 10 during insertion in to the socket.

A protector 21 is provided between the home position of the contact 31, at which the contact stays when the electric component is not inserted into the socket, and the insertion position of the semiconductor component 10. The protector 21 protects the contact 31. As shown in FIG. 2(B), the protector 21 extends beyond the outside the outside surface of the contact 31 when the semiconductor component 10 is not inserted into the socket. By positioning the protector 21 such that it protects beyond the outside surface of the contact 31, the protector 21 can protect the contact 31 by preventing the contact 31 from unnecessarily contacting parts of the semiconductor component 10 other than the electric terminal 12 during insertion and removal of the semiconductor component 10 into and from the socket.

FIG. 3 shows a socket and a semiconductor component 10 at an intermediate position during insertion of the semiconductor component 10 into the socket when the contact 31 contacts with the electric terminal 12. When the semiconductor component 10 is inserted into the socket, the semiconductor component 10 pushes the movable separation member 40 downwardly and moves the movable separation member 40 in the downward direction. At this time, the spring 50 is compressed, and presses the movable separation member 40 against the semiconductor component 10. Because the movable separation member 40 moves in the downward direction, the pushing member 32 pushes the contact 31 in contact with the electric terminal 12.

FIG. 4 shows a socket and a semiconductor component 10 with the semiconductor component 10 inserted further into the socket so as to completely engage with the socket. During insertion of the semiconductor component 10, as shown in FIGS. 3 to 4, the contact 31 wipes or rubs against the electric terminal 12 of the semiconductor component 10. As used herein, wiping means moving while in contact, although the electric terminal 12 may or may not be scraped by this motion. Because dirt, oil and oxidized membrane attached to the surface of the electric terminal 12 can be removed by this wiping or rubbing contact, the contact 31 can make a firm and good electrical contact with the electric terminal 12.

The contact 31 of the present embodiment wipes only a portion of the electric terminal 12, so the deterioration or wear of the contact 31 can be prevented as compared to a conventional socket. However, the contact 31 gradually deteriorates a wears out due to the friction with a portion of the electric terminal 12. To overcome this problem, the pin holder 38 of the present embodiment can be removed from the housing 20. The pin holder 38 and the pin 34 can thus be easily exchanged and replaced. Furthermore, the conductive layer 33 and the insulating layer are formed in a part of the surface area of each pin 34 which does not contact with the electric terminal 12 of the semiconductor component 10 or the movable separation member 40. Therefore, wear of the conductive layer 33 and the insulating layer can be prevented.

Figure 5:
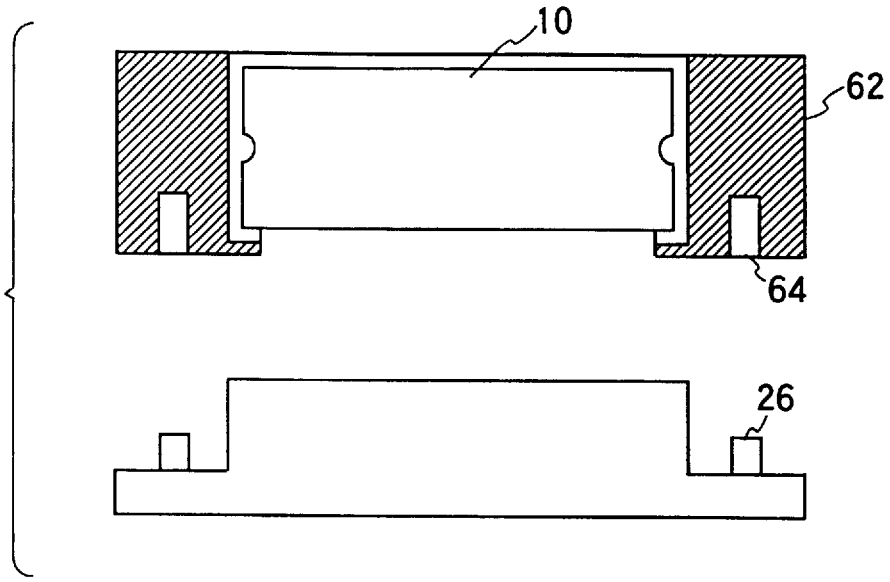
FIG. 5 shows a socket and semiconductor component 10 when the semiconductor component 10 held by a carrier 62 is inserted into the socket.

FIG. 5 shows a socket and semiconductor component 10 with the semiconductor component 10 held by the carrier or insert 62 for insertion into the socket. In this embodiment, the socket itself does not hold the semiconductor component 10. Instead, the carrier 62 holds the semiconductor component 10. The carrier 62 has guide holes 64 for positioning the semiconductor component 10 with the socket. The socket has guide pins 26 to fit into the guide holes 64 of the carrier 62. The tip of each guide pin 26 is tapered and the rim of each guide hole 64 is preferably chamfered, so that the semiconductor component 10 and the carrier 62 can be easily inserted into the socket.

In the embodiment of FIG. 5, the guide pin 26 can be removed from the housing 20. Therefore, a guide pin 26, which is worn out by contacting with the rim of the guide hole 64, can be exchanged with a new guide pin 26. Furthermore, at least part of the surface area of the guide pin 26 can be covered by a metal. By use of a metal covering, abrasion of the guide pin 26, which is caused by contact with the rim of the guide hole 64, can be effectively prevented.

If a number of semiconductor components 10 are successively inserted into a socket for testing, it is preferable to reduce the replacement time as much as possible. For this reason, the semiconductor components 10 to be tested are held in advance by the carrier 62. A comparatively long time is needed to fix the semiconductor component 10 to the carrier 62. However, by fixing in advance the semiconductor component 10 to be tested next in the carrier 62, while another semiconductor component 10 is being tested, the semiconductor components 10 can be tested more rapidly.

Figure 6:
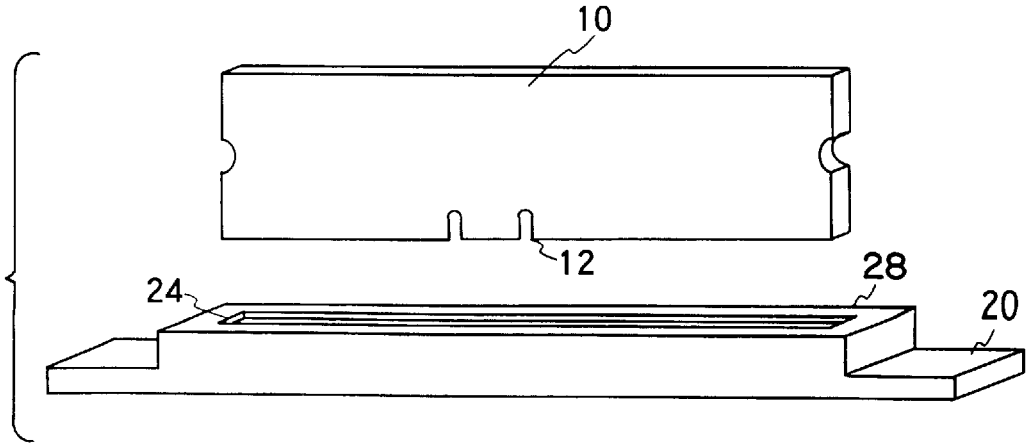
FIG. 6 shows another embodiment for positioning the semiconductor component 10 against the socket.

FIG. 6 shows another embodiment of the alignment between the socket and the semiconductor component 10 to be inserted. A slot 26, the rim of which is chamfered, is provided on the upper part of the socket. Because the taper part 24 is provide at the upper interior of the slot 28, the semiconductor component 10 can be easily inserted into the predetermined insertion position of the socket.

Figure 7:
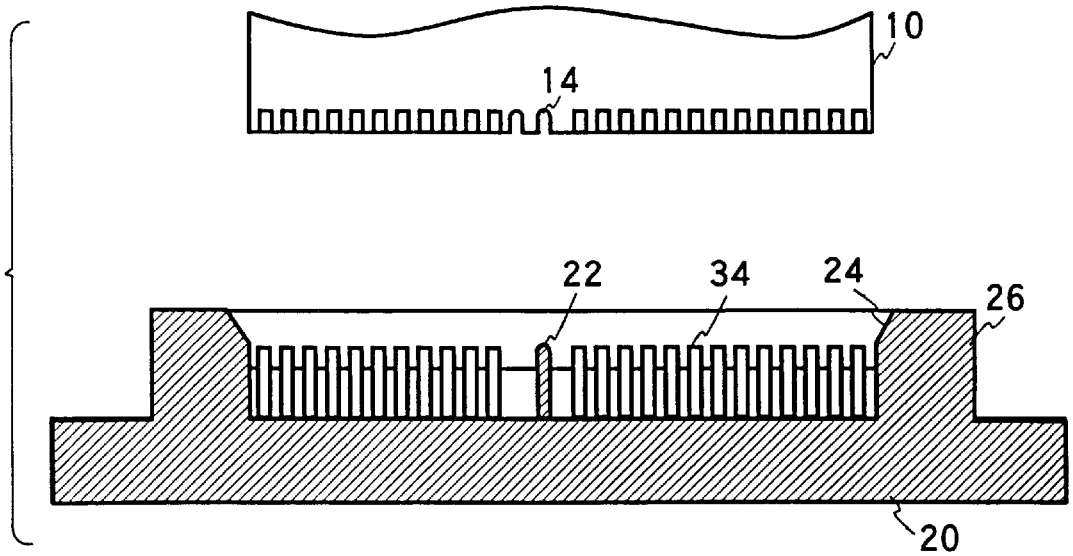
FIG. 7 shows a cross sectional view of the socket shown in FIG. 6.

FIG. 7 shows the cross section of the socket shown in FIG. 6. This semiconductor component 10 is, for example, a RMMI type semiconductor module which has a notch 14 for alignment. The notch 14 is an example of a reference part for alignment. A projection 22 is provided inside the socket. The projection 22 is an example of a reference corresponding member, which engages with the notch 14. Using the notch 14 and the projection 22, the semiconductor component 10 can be easily held at the correct position in the socket.

Figure 8A:
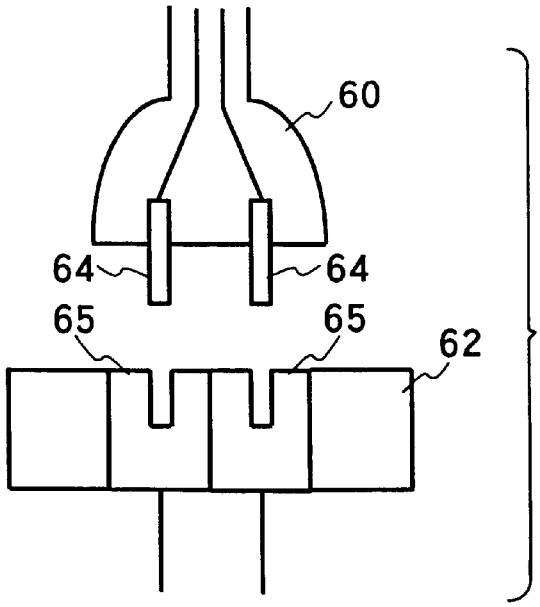
FIGS. 8A and 8B shows an example of use of the socket of the present invention.
Figure 8B:
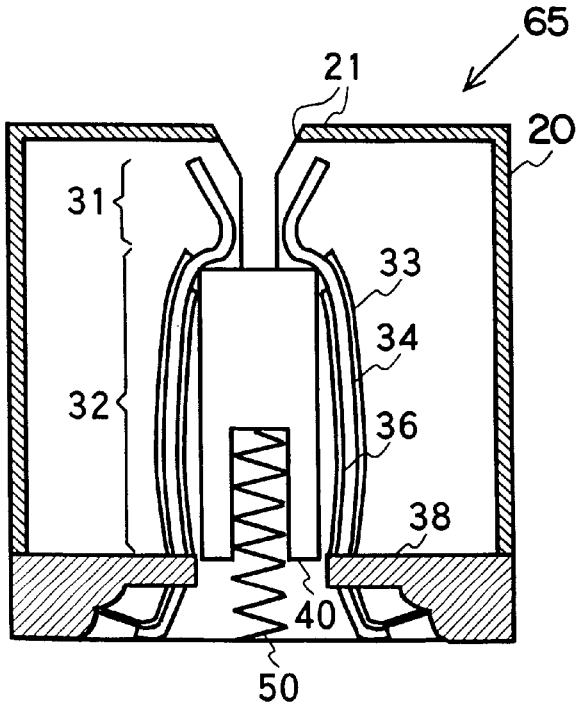

FIGS. 8A and 8B shows an example of use of the socket of the resent invention. FIG. 8(A) shows a configuration of a power supply plug 60, as an example of the electric components, and a plug socket 62, as an example of the socket. FIG. 8(B) shows a detailed configuration of a socket body 65 of a plug socket 62. Here, the same reference numerals are provided for elements having the same function as elements shown in FIG. 2. The power supply plug 60 has a plurality of plug pins 64, but in FIG. 8, for example, two plug pins 64 are provided. The plug pin 64 is an example of an electric terminal 12. The plug socket 62 has socket bodies 65 for connecting each plug pin 64 and the power supply.

Referring to FIG. 8B, the socket body 65 has a housing 20, a pin holder 38, pins 34, conductive layers 33 and 36, an insulating layer, a movable separation member 40, a spring 50, and a protector 21. The housing 20 supports the pin holder 38. The pins 34 are installed on the pin holder 38. The conductive layers 33 and 36 are provided on the surface of the pins 34. The insulating layer such as epoxy resin is provided between the conductive layers 33 and 36 and the pins 34. The pins 34 have a contact 31 and a pushing member 32. The contact 31 contacts with the electric terminal of the electric component. The pushing member 32 pushes the contact 31 toward the electric terminal of the electric component.

In the case of the plug socket 62, when the plug pin 64 of the power supply plug 60 is beginning to be inserted into the opening of the socket body 65, the plug pin 64 pushes the movable separation member 40 in a downward direction without contacting with the contact 31. If the plug pin 64 is then further inserted into the socket body 65, the contact 31 gradually moves toward the plug pin 64 as the movable separation member 40 moves down. Next, if the plug pin 64 reaches a predetermined depth, the contact 31 contacts with the plug pin 64. If the plug pin 64 is then further inserted to go deeper into the socket body 65, the contact 31 wipes the plug pin 64. Therefore, the deterioration of the contact 31 and the plug pin 64 can be effectively prevented.

Figure 9A:
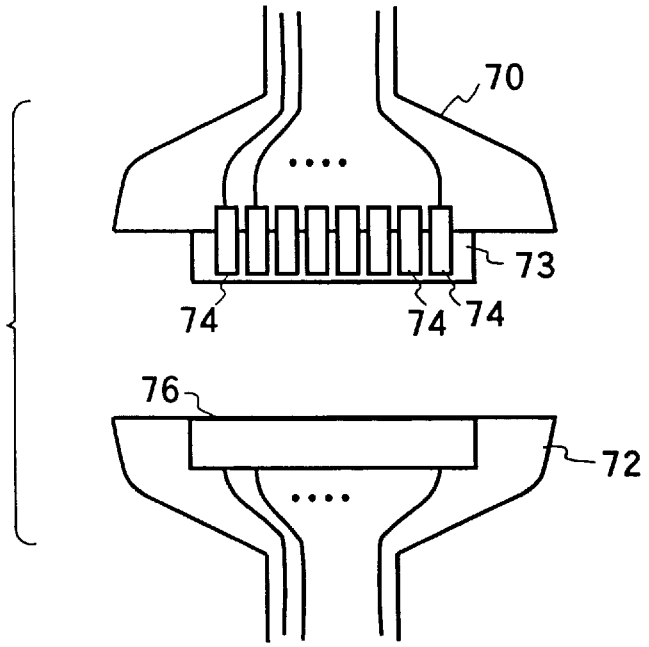
FIGS. 9A and 9B shows another example of use of the socket of the present invention.
Figure 9B:
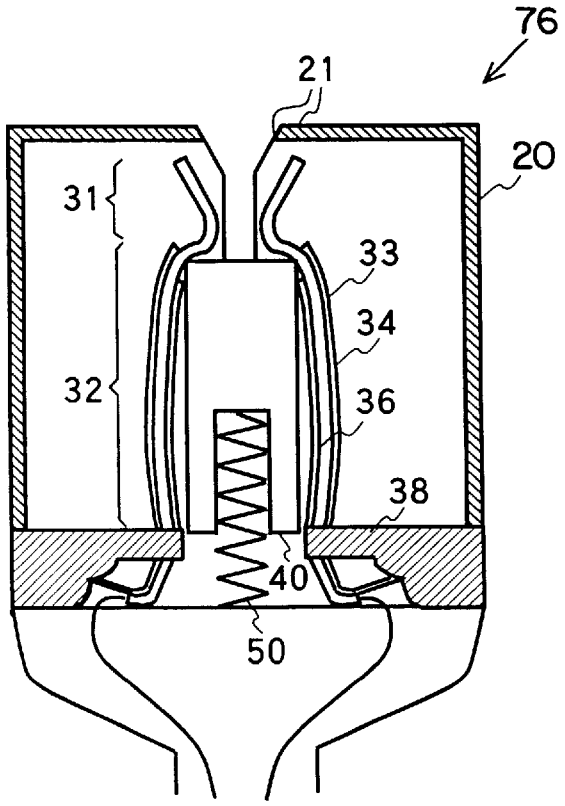

FIG. 9 shows another example of use of the socket present invention. FIG. 9(A) shows a configuration of a male plug 70 as an example of an electric component, and a female plug 72 as an example of a socket. FIG. 9(B) shows a cross section of a female plug 72. Here, the same reference numerals are provided to the elements having the same function as the elements shown in FIG. 2. The male plug 70 has a plurality of electrodes 74 as an example of an electric terminal, and a holding member 73, to hold the electrode 74 at a predetermined position. The female plug 72 has a socket body 76 to contact with each of the electrodes 74.

The socket body 76 has a housing 20, a pin holder 38, pins 34, conductive layers 33 and 36, an insulating layer, a movable separation member 40, a spring 50, and a protector 21. The housing 20 supports the pin holder 38. The pins 34 are installed on the pin holder 38. The conductive layers 33 and 36 are provided on the surface of the pins 34. The insulating layer, for example, an epoxy resin is provided between the conductive layers 33 and 36 and the pin 34. The pin 34 has a contact 31 and a pushing member 32. The contact 31 contacts with the electric terminal 12 of the electric component. The pushing member 32 pushes the contact 31 toward the electric terminal of the electric component.

When the holding member 73 of the male plug 70 is just being inserted into the opening of the socket body 76 in the female plug 72, the holding member 73 pushes the movable separation member 40 in a downward direction. At this time, the electrodes 74 do not make contact with the contact 31. If the holding member 73 is then further inserted into the socket body 76, the contact 31 gradually moves toward the electrodes 74. Next, when the holding member 73 reaches a predetermined depth with respect to the socket body 76, the contact 31 contacts with the electrode 74. If the holding member 73 is then inserted further to move deeper into the socket body 76, the contact 31 wipes the electrode 74. Therefore, the deterioration of the contact 31 and electrode 74 can be effectively prevented.

Figure 10A:
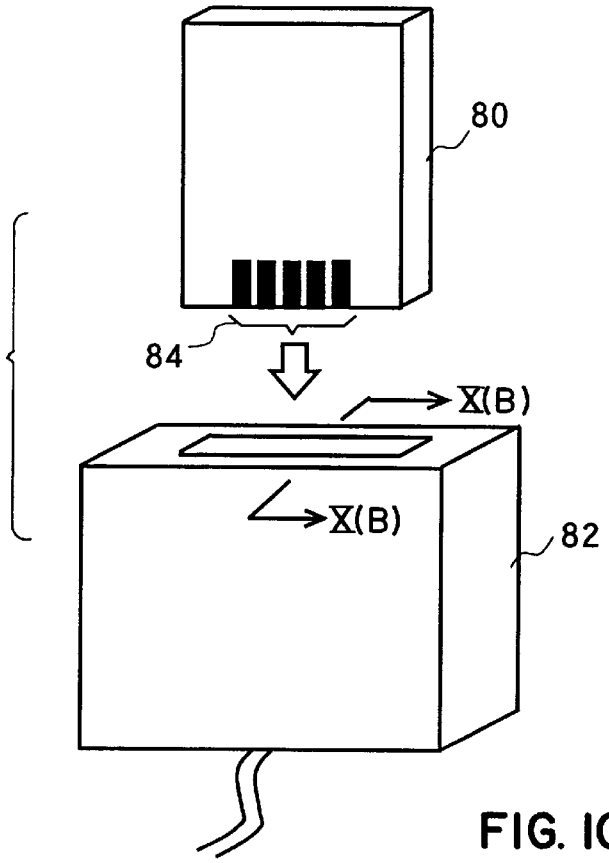
FIGS. 10A and 10B shows yet another example of use of the socket of the present invention.
Figure 10B:
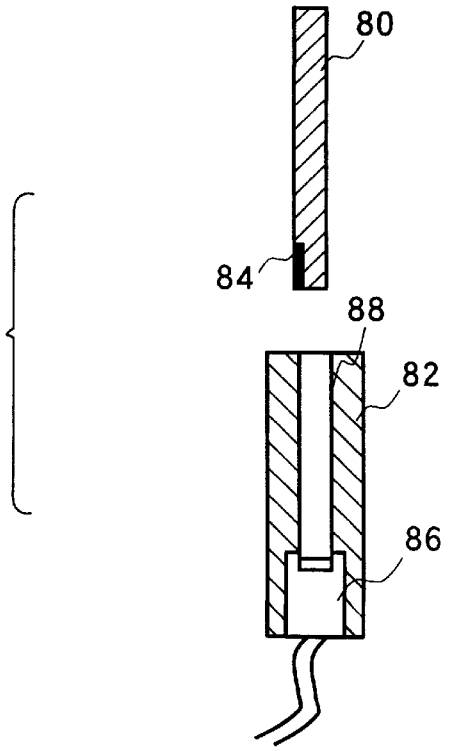
Figure 11A:
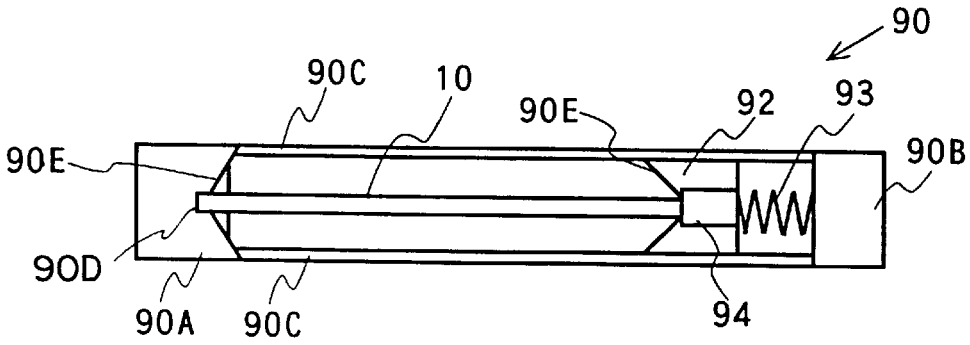
FIGS. 11A to 11D shows a configuration of a connector of the present invention.
Figure 11B:
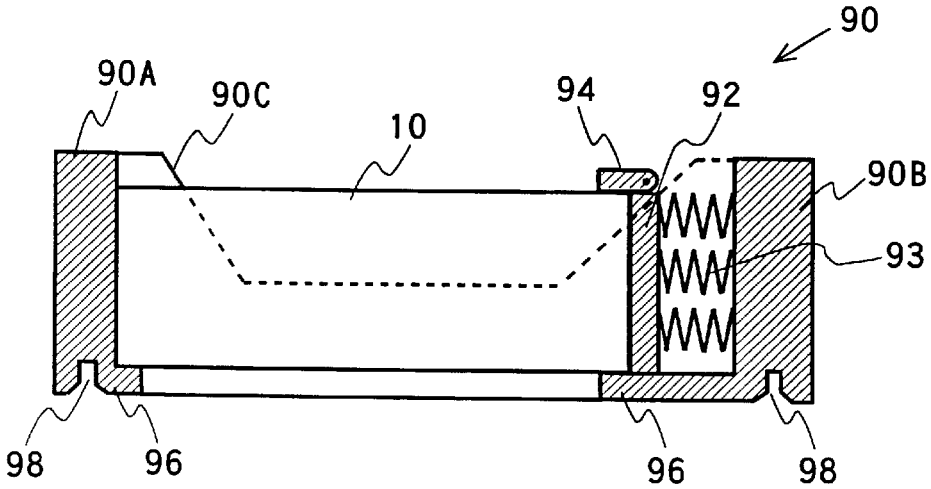
Figure 11C:
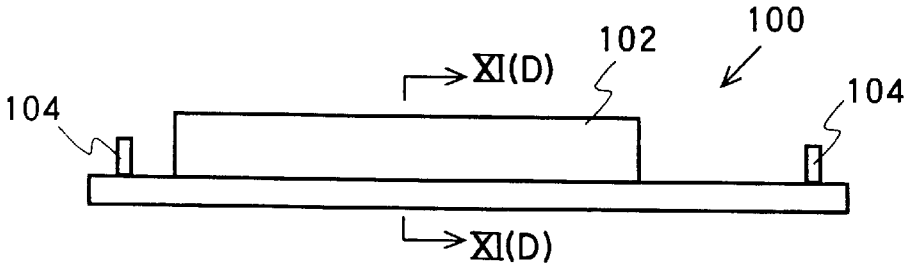
Figure 11D:
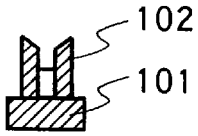
Figure 12A:
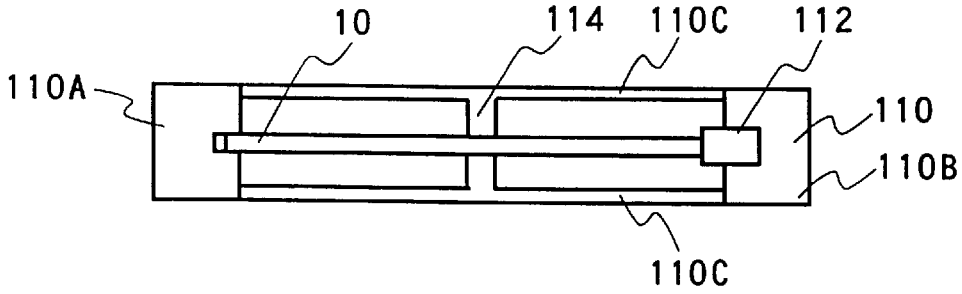
FIGS. 12A to 12D shows a configuration of a connector of another embodiment of the present invention.
Figure 12B:
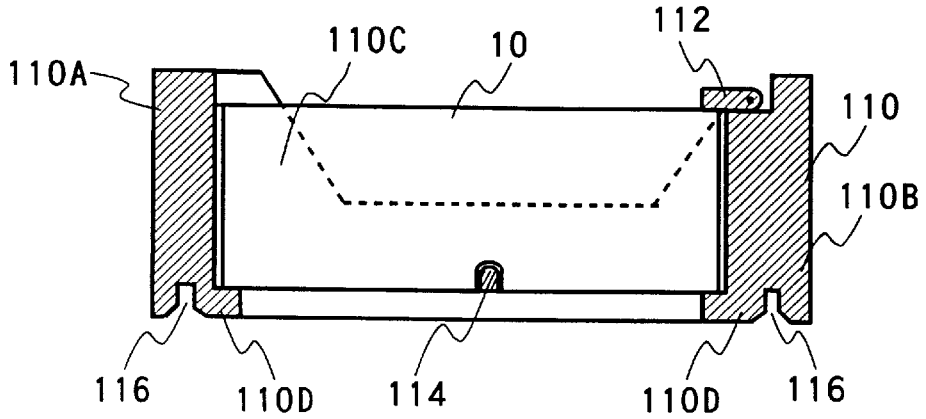
Figure 12C:
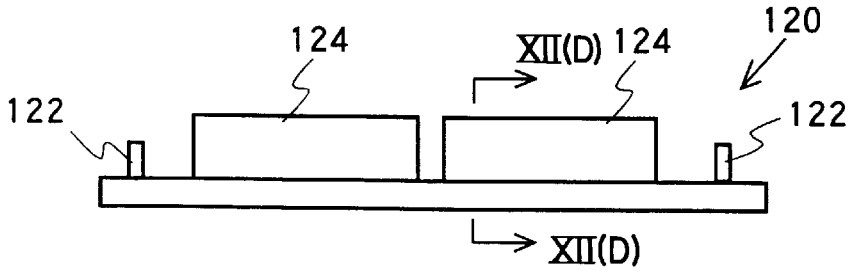
Figure 12D:
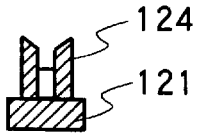

FIG. 10 shows another example of use of the socket of the present invention. FIG. 10(A) shows an oblique view of an IC card 80, as an example of an electric component, and a card connector 82, as an example of the socket. FIG. 10(B) shows a cross sectional view of an IC card 80 and a card connector 82 along line A—A in FIG. 10A. Examples of an IC card 80 include a modem card, an ISDN card, a flush memory card, smart media and so on. The IC card 80 has an IC inside and has an electrode 84 as an electric terminal to output signals. A card connector 82 has a socket body 86 and a card guiding member 88. The card guiding member 88 introduces the IC card 80 into the socket body 86. The socket body 86 has the same configuration as the socket shown in FIG. 2.

When the IC card 80 is inserted into the socket body 86 of the card connector 82 along the card guiding member 88, the electrode 84 contacts with the contact of the socket body 86. Here, because the socket body 86 has the same configuration as the socket described above and the socket body 72 shown in FIG. 9, the deterioration of the contact and the electrode 84 can be effectively prevented.

FIG. 11 shows a configuration of a connector of the present invention. FIG. 11(A) shows a top view of an inserter 90. FIG. 11(B) shows a cross sectional view of an inserter 90. FIG. 11(C) shows a front view of a socket 100. FIG. 11(D) shows a B—B cross sectional view of the socket 100 shown in FIG. 11(C) along line B—B in FIG. 10C. The connector has an inserter 90, which holds a semiconductor component 10, and a socket 100. The inserter 90 has a pair of side walls 90C and end walls 90A and 90B. The side walls 90C have a rectangular shape which is notched with the shape of an inverse trapezoid. The side walls 90C and end walls 90A and 90B are formed together as one unit.

Bottom walls 96 are formed on the lower part of the wall surfaces of the opposite facing end walls 90A and 90B.

Furthermore, the inserter 90 has an elastic body 93 and a moving wall 92, as an example of a position fixing member and a sandwiching member. The moving wall 92 is connected to the end wall 90B through the elastic body 93. The moving wall 92 can move along the bottom wall 96 of the end wall 90B. A holding recess 90D and a taper 90E are formed on the opposite facing end wall 90A and moving wall 92. The holding recess 90D holds the semiconductor component 10. The taper 90E introduce the semiconductor component 10 into the holding recess 90D. The moving wall 92 has an upper fixing member 94 which fixes the semiconductor component 10 by pushing the semiconductor component 10 towards the bottom wall 96.

Furthermore, the end walls 90A and 90B have a positioning hole 98 as a first structure member having an opening for viewing a second structure member, as described hereinafter. A positioning pin 104 can be inserted into the positioning hole 98. The positioning pin 104 is formed in a socket 100, which will be explained below. The inserter 90 can be located in a predetermined position in the socket 100. The socket 100 has a pedestal 101 and a socket body 102. The socket body 102 is held on the pedestal 101. The socket body 102 has the same configuration as the socket shown in FIG. 2. The socket 100 has a positioning pin 104 as an example of a second structure member to be inserted into the positioning hole 98 of the inserter 90. Therefore, the inserter 90 can be positioned at a predetermined position in the socket 100.

To fix the semiconductor component 10 in the inserter 90, the moving wall 92 is moved toward the end wall 90B and fixed. The space between the end wall 90A and the moving wall 92 can then be used for inserting the semiconductor component 10. The semiconductor component 10 is then inserted into the said space. Next, since the moving wall 92 can move freely, the moving wall 92 moves sideways toward the end all 90A. The inserted semiconductor component 10 is then sandwiched by the moving wall 92 and end wall 90A and fixed. Here, because the moving wall 92 and the end wall 90A have the taper 90E, the semiconductor component 10 is introduced into the holding recess 90D by the taper 90E and held in the holding recess 90D. Therefore, the semiconductor component 10 can be accurately fixed at a predetermined position in the inserter 90. Furthermore, the present embodiment can fix the semiconductor component 10 by pushing the semiconductor component 10 toward the bottom wall 96 by the upper fixing member 94.

To connect the semiconductor component 10 to the socket 100, the inserter 90, on which the semiconductor component 10 is mounted, can be connected to socket 100. The inserter 90 and socket 100 can be accurately positioned by connecting the inserter 90 and the socket 100 so that the positioning hole 98 are engaged with the positioning pins 104. Therefore, the semiconductor component 10, which is accurately positioned and mounted on the inserter 90, is inserted accurately and rapidly into the predetermined position of the socket body 102. Because the socket body 102 has the same configuration as the configuration shown in FIG. 2, the deterioration of the contact can be effectively prevented.

FIG. 12 shows a configuration of a connector of another embodiment of the present invention. FIG. 12(A) shows a top view of an inserter 110. FIG. 12(B) shows a cross sectional view of an inserter 110. FIG. 12(C) shows a front view of a socket 120. FIG. 12(D) shows a cross-sectional view of the socket 120 along line C—C shown in FIG. 12(C). The connector has an inserter 110, which holds the semiconductor component 10, and a socket 120. The inserter 110 has a pair of side walls 110C and end walls 110A and 110B. The side walls 110C have a rectangular shape with an inverse trapezoid shape cut out. The side walls 110C and end walls 110A and 110B are formed together as one unit.

A bottom wall 110D is formed on the lower part of the wall surfaces of the opposite facing end walls 110A and 110B. The bottom wall 110D holds the semiconductor component 10 from the bottom. The opposite facing side walls 110C have a projection 114 as an example of a reference member. The projection 114 engages with a notch 14 of the semiconductor component 10, in the position where the semiconductor component 10 is to be inserted. The end wall 110B has an upper fixing member 112 which fixes the semiconductor component 10 by pushing the semiconductor component 10 toward the bottom wall 110D.

Furthermore, the end walls 110A and 110E have a positioning hole 116 as a first structure member having an opening. A positioning pin 122 of the socket 120 can be inserted into the positioning hole 116. The positioning pin 122 is formed in a socket 120, which ill be explained below. As described below, with the positioning pin 122, the inserter 110 can be positioned in the predetermined position in the socket 120.

The socket 120 has a pedestal 121 and a socket body 124. The socket body 124 is held on the pedestal 121. The socket body 124 has the same configuration as the configuration of the socket shown in FIG. 2. The socket 120 has a positioning pin 122, as an example of a second structure member, to be inserted in o the positioning hole 116 of the inserter 110. Therefore, the inserter 110 can be positioned at a predetermined position in the socket 120.

To fix the semiconductor component 10 in the inserter 110, the semiconductor component 10 is inserted into the space between the end walls 110A and 110B and pushed toward the bottom wall 110D. Using this pushing motion, the semiconductor component 10 is positioned inside the inserter 110 so that the notch 14 is engaged with the projection 114 of the inserter 110. Following this positioning, the semiconductor component 10 is fixed in place by pushing it toward the bottom wall 110D using the upper fixing member 112. Therefore, the semiconductor component 10 can be accurately fixed at a predetermined position in the inserter 110.

To connect the semiconductor component 10 to the socket 120, the inserter 110, on which the semiconductor component 10 is mounted, can be connected to socket 120. The inserter 110 and socket 120 can be accurately positioned by connecting the inserter 110 and the socket 120 so that the positioning hole 116 are engaged with the positioning pins 122. Therefore, the semiconductor component 10, which is accurately positioned and fixed on the inserter 110, is accurately and rapidly inserted into a predetermined position of the socket body 124. Because the socket body 124 has the same configuration as the configuration of the socket shown in FIG. 2, the deterioration of the contact can be effectively prevented.

Figure 13A:
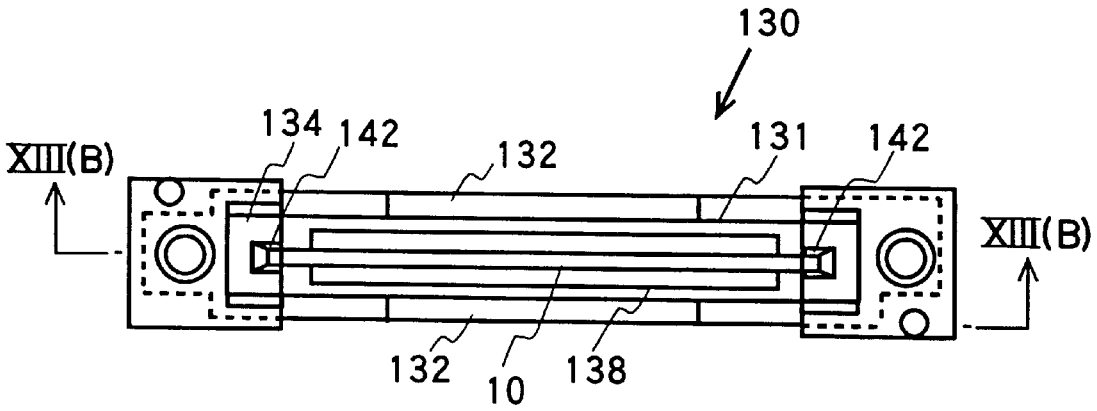
FIGS. 13A and 13B shows a configuration of an inserter connector of another embodiment of the present invention.
Figure 13B:
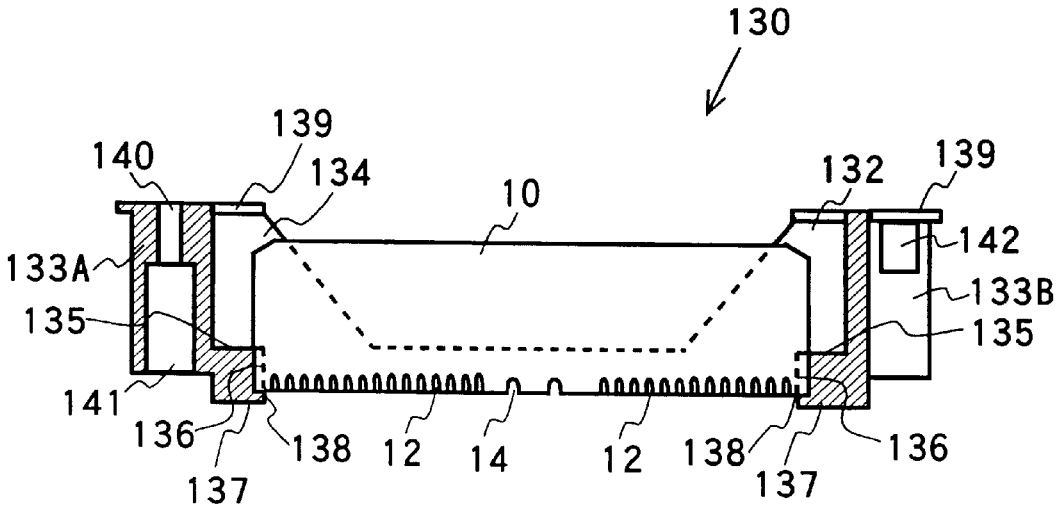

FIG. 13 shows a configuration of a connector of another embodiment of the present invention. FIG. 13(A) shows a top view of an inserter 130. FIG. 13(B) shows a cross-sectional view of the inserter 130 along line D—D shown in FIG. 13(A). In this embodiment, it is supposed that the semiconductor component 10 has a notch 14 as an example of a reference member for positioning. The inserter 130 has a pair of side walls 132. The side walls 132 have a rectangular shape with the shape of an inverse trapezoid cut out. The side walls 132 are formed together with the end walls 133A and 133B as one unit. Therefore, receiving space 134 for receipt of the semiconductor component 10 is formed inside the inserter 130. The side walls 132 and end walls 133A and 133B are made from a material such as synthetic resin.

The end walls 133A and 133B have boss members 135 which protrude into the receiving space 134. Each boss member 135 has a holding recess 136 and a holding bottom wall 137. The holding recess 136 holds the semiconductor component 10. The holding bottom wall 137 holds a part of the lower portion of the semiconductor component 10. A part of the lower portion of the receiving space 134 other than the holding bottom wall 137 of the boss member 135 becomes a penetrating hole 138. Therefore, the electric terminal 12 of the semiconductor component 10, which is held by the holding bottom wall 137, is exposed at the lower side through the penetrating hole 138.

Both sides of the ends of the semiconductor component 10 can be inserted into or removed from the holding recess 136 from the upper side of the inserter 130. The upper part of the holding recess 136 is a taper shaped guiding recess 142 to introduce both ends of the semiconductor component 10 to the inside of the holding recess 136. The holding recess 136 has a configuration having a clearance that allows the held semiconductor component 10 to move slightly.

Furthermore, the end walls 133A and 133B have a positioning hole 141 as a first structure member having an opening. A positioning pin 156 can be inserted into the positioning hole 141. The positioning pin 156 (see FIG. 14) is formed on the socket guide 152 of a socket 150, which will be explained below. The inserter 130 can be positioned at a predetermined position in the socket 150.

Figure 14:
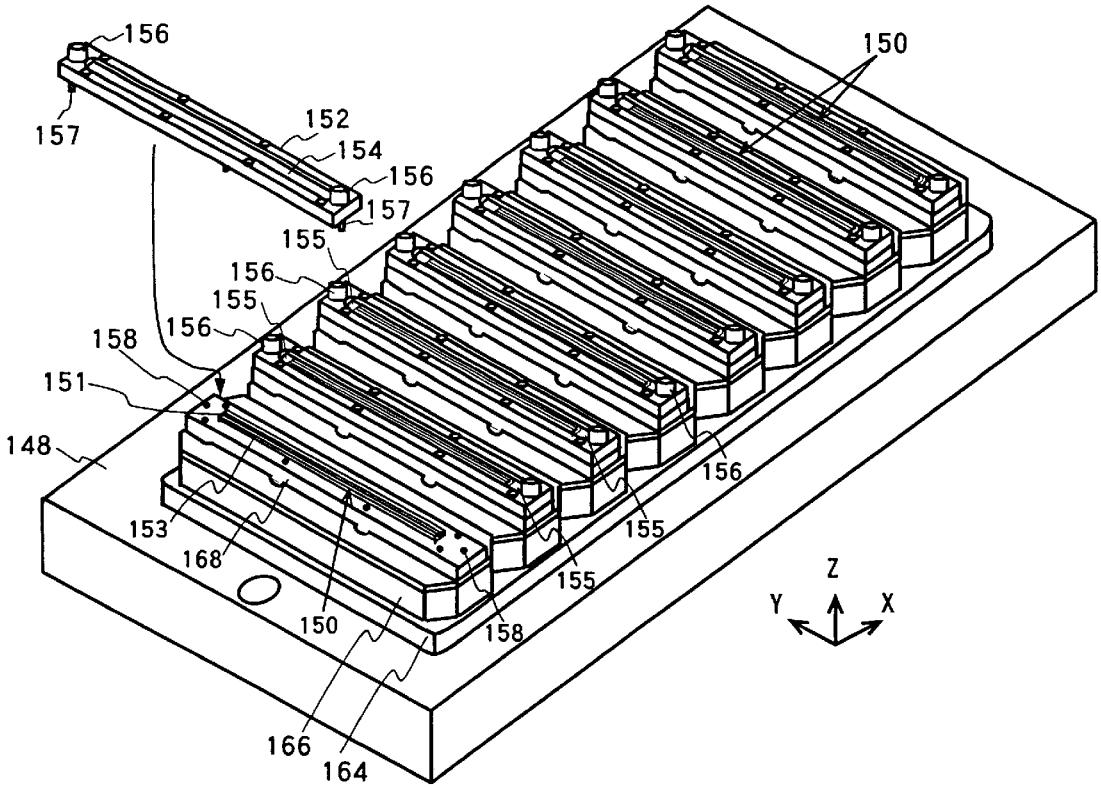
FIG. 14 shows a configuration of a socket of the connector of another embodiment of the present invention.
Figure 16:
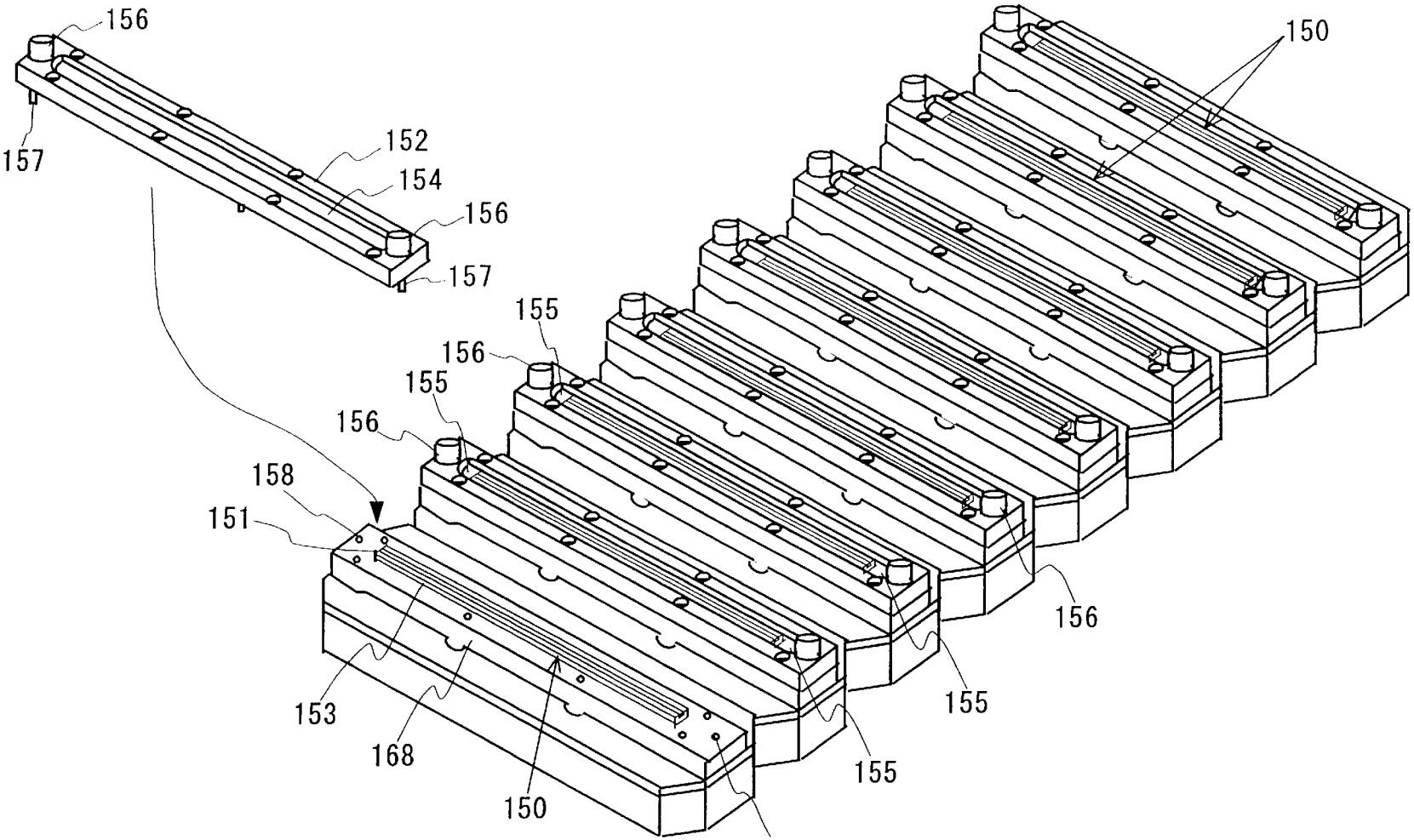
FIG. 16 shows an enlarged view of the socket in FIG. 14.

FIG. 14 shows a configuration of a socket of the connector of another embodiment of the present invention. An enlarged view of the socket is shown in FIG. 16. The socket is used for a testing apparatus that tests semiconductor components. In FIG. 14, the Z axis is taken in the direction vertical to the ground surface of a test head base 148, and the X axis and Y axis are taken in the directions perpendicular to each other on a plane perpendicular to the Z axis. The test head base 148 used for testing apparatus has a common test board 164. A plurality of individual test boards 166 are connected onto the common test board 164 parallel to the Y axis. A socket 150 is connected onto each of the individual test boards 166.

The socket 150 has a pedestal 168, a socket body 153, and a socket guide 152. The socket body 153 has a socket recess 151 which is formed parallel to the Y axis. The socket body 153 is held on the pedestal 168. The socket body 153 has the same configuration as the socket shown in FIG. 2. The socket guide 152 has a penetrating hole 154, which extends longitudinally in the Y direction. The socket guide 152 is installed around the socket body 153 on the pedestal 168 so that a positioning pin 157 can be inserted into a positioning hole 158 formed on the pedestal 168. An escaping recess 155 is provided at each and of the socket body 153 between the end of the socket body 153 and the socket guide 152. The boss members 135 of the end walls 133A and 133B of the inserter 130 (shown in FIG. 13B) can be inserted into the escaping recess 155. The socket guide 152 has a positioning pin 156 as an example of a second structure member to be inserted into the positioning hole 141 of the inserter 130 (see FIG. 13B). Therefore, the inserter 130 can be positioned at a predetermined position in the socket 150.

Figure 15:
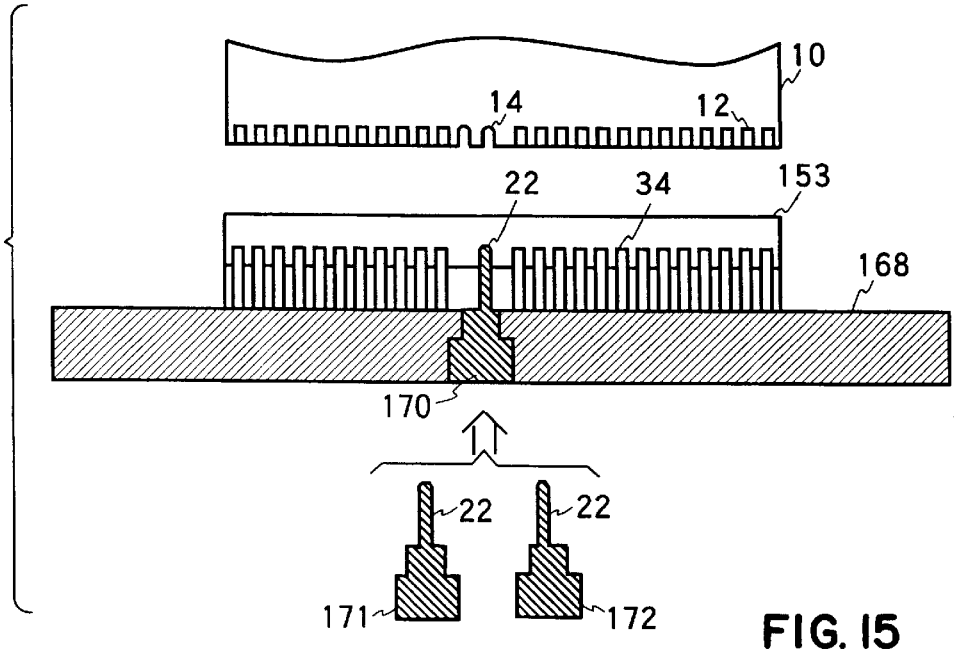
FIG. 15 shows a cross sectional view of a socket body of the connector of another embodiment of the present invention.

FIG. 15 shows a cross sectional view of a socket body of the connector of another embodiment of the present invention. The socket has the same configuration as the socket shown in FIG. 2 such as a pin 34. In this figure, the parts of the members having the same configuration are abbreviated. The socket body 153 has a projection unit 170 which includes a projection 22. The projection 22 is an example of a reference corresponding member that engages with a notch 14 in the semiconductor component 10. The projection 22 is positioned on projection unit where of the semiconductor component 10 is to be located when the semiconductor component 10 is inserted into the socket body 153. Using this projection unit 170, the semiconductor component 10 can be easily and accurately inserted into the desired insertion position. The projection unit 170 is detachably held by the pedestal 168 , which is an example of a reference corresponding member holder, such that the projection unit 170 can be attached onto or removed from the pedestal 168. Therefore, when inserting a semiconductor component 10 without the notch 14 into the socket body 153, the semiconductor component can be inserted into the socket body 153 without interference by removing the projection unit 170. Furthermore a projection unit having a different specification of projection 22 can be used according to the accuracy required in positioning when the semiconductor component 10 when it is inserted into the socket body 153.

The pedestal 168 can hold other projection units 171 or 172 by removing the projection unit 170 to allow the convex protection unit 171 or 172 to be attached onto or removed from the pedestal 168. The convex protection unit 171 or 172 has the projection 22 in a position where the projection 22 can be engaged with the notch of other semiconductor components which have the notch in different positions. Therefore, even a plurality of kinds of semiconductor components having notches in different positions can be inserted accurately into the socket body 153.

In the connector of present embodiment, the inserter 130, which holds the semiconductor component 10, is connected to the socket 150 as described hereinafter. Initially, the inserter 130 and the socket 150 are accurately positioned with respect to each other by the positioning hole 141 of the inserter 130 and the positioning pin 156 of the socket 150. At this time, the semiconductor component 10 held by the inserter 130 is located at an upper side nearby the socket 150 into which the semiconductor component 10 is to be inserted. Next, the semiconductor component 10 held by the inserter 130 is pushed down by a pushing apparatus (not shown). Using this downwardly pushing motion, the semiconductor component 10 is inserted into the socket body 153 such that the notch 14 of the semiconductor component 10 engages with the projection 22 of the socket 150. Therefore, the semiconductor component 10 can be accurately inserted into the insertion position. Furthermore, because the socket body 153 has the configuration shown in FIG. 2, the deterioration and wear of the contact can be effectively prevented as described above.

Although the present invention has been described with reference to specific embodiments, the scope of the present invention is not limited to these embodiments. For example, in the above embodiments, the semiconductor component 10 has the notch 14, and the socket body 153 has the projection 22. The present embodiment is not limited to this arrangement, as the semiconductor component 10 can have the projection 22, and the socket body 153 can have the notch 14. In short, the semiconductor component and the socket may have a configuration such that the semiconductor component can engage with the socket.

Furthermore, in the above embodiment, the inserter 110 has a projection 114 even in the case of inserting the semiconductor component 10 into the socket 120. This invention is not limited to this arrangement and, for example, the inserter 110 can have a configuration having the projection 114 which fixes the semiconductor component 10. Also, the inserter 110 can have a configuration which can remove the projection 114 when connecting the semiconductor component 10 to the socket 120.

As shown in the above embodiments, this invention can provide a socket and a connector in which an electric component can be inserted with a small force. The socket and connector have a high durability. The electric component can be easily a changed using the socket and the connector of the present invention.

Those skilled in the art can make various modifications and improvements to these embodiments of the present invention. It is clear from the appended claims that such modifications or improvements are also covered by the scope of the present invention.

What is claimed is:

1. A socket for receiving an electric component having an electric terminal, comprising:

a contact, to which said electric terminal is connected;

a driving mechanism for moving said contact toward said electric terminal when said electric component is inserted into an insertion position in said socket; and a pushing member, which is integrally formed with said contact into a single pin, for pushing said contact toward said electric terminal of said electric component inserted into said socket, wherein said contact and said pushing member are integrally formed into a single pin.

2. A socket as claimed in claim 1, wherein said driving mechanism has a movable separation member for keeping said contact away from said insertion position of said electric component when said electric component is not inserted in said socket.

3. A socket as claimed in claim 2, further comprising a spring which is compressed as said electric component is inserted into said socket, and pushes said movable separation member toward said electric component.

4. A socket as claimed in claim 1, wherein said electric component is a RIMM type semiconductor module having a plurality of electric terminals on both faces of said electric component, and said socket has a plurality of said contacts, each corresponding to one of said electric terminals.

5. A socket as claimed in claim 2, wherein:

said driving mechanism includes a mechanism for moving said movable separation member in response to said insertion of said electric component into said socket, and wherein said motion of said movable separation member causes said pushing member to bring said contact into contact with said electric terminal of said electric component.

6. A socket as claimed in claim 5, wherein said contact is wiped against said electric terminal of said electric component when said electric component is inserted into said socket.

7. A socket as claimed in claim 3, further comprising a housing accommodating said movable separation member and said spring, and a pin holder for holding said pin, said pin holder being detachable from said housing.

8. A socket as claimed in claim 1, wherein said housing has a protector for protecting said contact, said protector being positioned between a home position of said contact, at which said contact stays when said electric component is not inserted in said socket, and said insertion position of said electric component.

9. A socket as claimed in claim 1, further comprising a conductive layer formed in a part of a surface area of said pin, and an insulating layer for insulating said conductive layer from said pushing member.

10. A socket as claimed in claim 8, wherein said conductive layer and said insulating layer are formed in a part of said surface area of said pin, which area does not come into contact with said electric terminal of said electric component or said movable separation member.

11. A socket as claimed in claim 1, further comprising a positioning member which positions said electric component to an insertion position, into which said electric component is to be inserted, in said socket.

12. A socket as claimed in claim 11, wherein said positioning member has a taper part, which introduces said electric component into said insertion position, on at least part of a periphery of said insertion position.

13. A socket as claimed in claim 11, wherein:

said electric component has a reference member which is a reference for positioning said electric component against said socket, and said positioning member has:

a reference corresponding member, which engages with said reference member, at said insertion position.

14. A socket as claimed in claim 13, wherein said positioning member further has a reference corresponding member holder which holds said reference corresponding member at said insertion position so that said reference corresponding member can be inserted into and removed from said reference corresponding member holder.

15. A socket as claimed in claim 14, wherein:

said reference member is provided on different position according to types of said electric component, and said reference corresponding member holder can hold said reference corresponding member at a position where said reference corresponding member can engage with each said reference members of a plurality types of said electric components.

* * * * *